US006837007B2

(12) United States Patent
Floyd et al.

(10) Patent No.: US 6,837,007 B2
(45) Date of Patent: Jan. 4, 2005

(54) ROOF SUPPORT WITH INTEGRAL GUTTER

(75) Inventors: Gregory Floyd, Wooster, OH (US); Robb Willgohs, Fargo, ND (US)

(73) Assignee: Rubbermaid Inc., Wooster, OH (US)

( * ) Notice: Subject to any disclaimer, the term of this patent is extended or adjusted under 35 U.S.C. 154(b) by 0 days.

(21) Appl. No.: 10/046,015

(22) Filed: Jan. 10, 2002

(65) Prior Publication Data

US 2002/0092245 A1 Jul. 18, 2002

Related U.S. Application Data

(60) Provisional application No. 60/261,396, filed on Jan. 12, 2001.

(51) Int. Cl.[7] ..... E04H 1/00
(52) U.S. Cl. ..... 52/36.2
(58) Field of Search ..... 52/54, 36.2, 27.5, 52/18, 57, 82, 84, 271, 281, 282.1, 302.1, 302.3; 248/237, 227.2

(56) References Cited

U.S. PATENT DOCUMENTS

| | | | | | |
|---|---|---|---|---|---|
| 1,942,871 | A | | 1/1934 | McDonald | 108/16 |
| 2,711,138 | A | | 6/1955 | Hart | 108/6 |
| 3,352,077 | A | | 11/1967 | Slusser | 52/469 |
| 3,738,083 | A | * | 6/1973 | Shimano | 52/584.1 |
| 4,322,924 | A | * | 4/1982 | Cooper | 52/57 |
| 4,676,034 | A | | 6/1987 | Conley et al. | 52/11 |
| 5,038,529 | A | | 8/1991 | Conley et al. | 52/14 |
| 5,647,181 | A | * | 7/1997 | Hunts | 52/282.1 |
| 5,888,608 | A | | 3/1999 | Tsai | 428/105 |
| 6,000,176 | A | * | 12/1999 | Lancaster | 52/198 |
| 6,085,469 | A | * | 7/2000 | Wolfe | 52/198 |
| 6,151,845 | A | * | 11/2000 | Lancaster | 52/57 |
| 6,173,547 | B1 | * | 1/2001 | Lipson | 52/582.1 |
| 6,250,022 | B1 | * | 6/2001 | Paz et al. | 52/71 |
| 6,279,290 | B1 | * | 8/2001 | Richardson | 52/734.2 |
| 6,449,910 | B1 | * | 9/2002 | Budd | 52/58 |
| 2001/0029708 | A1 | * | 10/2001 | Richardson | |
| 2002/0148695 | A1 | * | 10/2002 | Latsko | |

FOREIGN PATENT DOCUMENTS

| | | | |
|---|---|---|---|
| DE | 1108 889 | 4/1955 | 8/1 |
| FR | 729.417 | 1/1932 | |
| GB | 2 124 672 A | 3/1984 | 1/12 |
| GB | 2 337 775 A | 1/1999 | 1/61 |

OTHER PUBLICATIONS

Richardson, Oct. 2001, US Patent Application Publication #2001/0029708A1.*

Latsko, Oct. 2002. US Patent Application Publication #2002/0148695.*

A copy of European Search Report EP 02 40 0004, Nov. 29, 2002.

* cited by examiner

*Primary Examiner*—Leslie A. Braun
*Assistant Examiner*—A. Joseph Wujciak
(74) *Attorney, Agent, or Firm*—Marshall, Gerstein & Borun LLP

(57) ABSTRACT

A roof support with an integral gutter including a roof support, a panel joint cover, and a gutter for a small storage or utility building or shed having a shallow-pitched roof. In particular, the roof support with integral gutter includes a support web, an exposure surface perpendicularly bisecting the support web, and a collector perpendicularly bisecting the support web opposite the exposure surface. The roof support with integral gutter is made by the pultrusion process, which eliminates the need for additional and separate components to provide rigidity and strength to the roof support.

21 Claims, 3 Drawing Sheets

ROOF SUPPORT WITH INTEGRAL GUTTER

CROSS-REFERENCE TO RELATED APPLICATIONS

The present invention claims priority under 35 U.S.C. § 119 from U.S. Provisional Patent Application No. 60/261,396 titled "Integral Rain Gutter" filed Jan. 12, 2001, the full disclosures of which is hereby incorporated by reference.

BACKGROUND OF THE INVENTION

Field of the Invention

The present invention relates to a roof structure, and more particularly, to a roof structure having an integral rain gutter.

It is generally known to provide for a roof support located along a central peak of pitched roofs for small storage and utility buildings or sheds having shallow-pitched roof panels. Such roof supports typically span the length of the roof and provide structural support at the joint between sloped roof panels which abut along the roof peak. The roof support may typically include a separate cover portion to cover the joint and reduce exposure of the joint and shed interior to snow, rain and other weather elements. Roof supports of this type are typically made from lightweight materials and assembled from multiple components manufactured by a thermoplastic molding or extrusion process.

However, such molded and/or extruded thermoplastic roof support assemblies have several disadvantages including roof sagging and concomitant water leakage. Such sagging and leakage is typically due to the relatively low rigidity and the temperature and time dependent creep of the thermoplastic roof support material. These disadvantages have required manufacturers to attempt to develop roof supports that are more rigid, thereby preventing roof sagging and subsequent water leakage. For example, roof supports are now designed to include separate steel rods that are inserted within the extruded roof support to provide more rigidity to the roof support and limit deflection and creep of the roof supports.

Despite such improvements, roofs continue to sag and extruded roof supports continue to deflect, allowing water leakage at the joint. To overcome the water leakage problem, manufacturers began providing a rain gutter in combination with the roof support to capture and divert any water that penetrates the cover and joint along the roof peak to reduce leakage inside the building. Traditionally, rain gutters snap-on to the roof panels under the joint of the roof peak, and any water that creeps along the surface of the roof panels or enters the joint will be directed to the rain gutter for subsequent disposal. Although the addition of rain gutters help to prevent water leakage inside the building, it provides another piece of equipment to manufacture and does not alleviate the problems and disadvantages associated with roof sagging and roof support deflection. As a result, manufacturers have provided columns or other vertical supports within the building to bolster the roof support, resulting in the additional expense associated with several manufacturing processes and assembly operations.

Accordingly, there exists a need for a roof support that provides more rigidity and which can also accommodate water leakage. Therefore, it is an objective of the present invention to provide a roof support with integral gutter. Another objective of the roof support with integral gutter of the present invention is to provide a roof support having higher strength and rigidity, which will limit roof support deflection and roof sag. A related objective of the roof support with integral gutter is that it should not require additional components, such as steel rods, to provide rigidity to the roof support.

Another objective of the roof support with integral gutter of the present invention is to provide a roof support with a panel joint cover and a gutter that are unitarily formed with the roof support by a single manufacturing process, thereby eliminating the necessity to separately manufacture each individual part, and reducing manufacturing costs.

Additionally, an objective of the roof support with an integral gutter is that it should be manufactured by a process that is easy to implement, is versatile, and produces a higher strength product to prevent roof sag that results in subsequent water leakage. Finally, it is an objective of the roof support with integral rain gutter that it provide all of the aforesaid objectives and advantages without incurring any substantial relative disadvantage.

SUMMARY OF THE INVENTION

The present invention relates to a roof support with an integral gutter including a roof support, a panel joint cover, and a gutter for a small storage or utility building or shed having a shallow-pitched roof. In particular, the roof support with integral gutter includes a support web, an exposure surface perpendicularly bisecting the support web, and a collector perpendicularly bisecting the support web opposite the exposure surface.

The exposure surface acts as the panel joint cover and is designed to fit over abutting roof panels to protect a joint formed therebetween from environmental conditions. The exposure surface also acts as the first barrier to water leakage inside the building. The exposure surface may have a negative angle with respect to the support web to correspond to the angle of the abutting roof panels to provide a seal between the roof panels and roof support, and to maintain continuity between the roof panels and the roof support.

The collector includes a distal edge angled from the plane of the lower portion of the collector to provide a channel between the distal edge and the support web, forming the integral gutter. The distal edge of the collector is angled away from the lower surface between about 90° and 175°, with a length great enough to provide the collector with a depth sufficient to direct a substantial volume of liquid along the collector. With the collector, any water or other moisture which penetrates the joint and the exposure surface will seep into the collector and be directed to a drain or away from the building.

The roof support with integral gutter may be used in combination with at least one roof panel having an exterior surface and an interior surface opposite the exterior surface. When two roof panels are used, the roof structure divides and supports each roof panel. Each roof panel abuts the support web, with a portion of the roof panel fitting between the exposure surface and the collector of the roof support. This permits the exposure surface to extend over the exterior surfaces of the roof panels and cover the joint formed between the roof panels. The roof panels are supported by the distal edges of the collector, which are closely adjacent to the interior surfaces of the roof panels. Each roof panel may also include a drip edge that extends longitudinally along the interior surface parallel to the support web of the roof support and intermediate the distal edge and the support web over the collector. The drip edge acts to disrupt the cohesive bond between the moisture and the roof panel surface so that the moisture drips from the interior surface at this point. The collector extends beyond the drip edge to capture any moisture that falls from the roof panel when the roof panel is situated intermediate the exposure surface and the collector.

In part, the present invention is a method of making a roof support. The method includes introducing fibers to a resin bath to form a fiber-resin combination, contouring the fiber-resin combination in the shape of a roof support and curing the resin-fiber combination. The roof support may be contoured to include a support web, an exposure surface and a collector. The roof support may then be cut to desired specifications.

This invention overcomes the problems and disadvantages associated with the related art by providing a roof support with integral gutter. The roof support with integral gutter has increased strength and rigidity to limit roof support deflection and roof sag. Further, the roof support with integral gutter of the present invention does not require additional components, such as steel rods, to provide the strength and rigidity to the roof support.

The roof support with integral gutter also provides a roof support with a panel joint cover and a gutter integrally formed with the roof support. This is accomplished by a single manufacturing process, and reduces parts inventory and manufacturing costs.

Also, the roof support with integral gutter of the present invention is manufactured by a process that is easy, versatile, and produces a high strength product. This results in a roof support that prevents roof sag and water seepage through and/or near the joint between roof panels. As is shown and described, the roof support with integral gutter of the present invention has one or more of these or other advantageous features, and achieves all of the aforesaid advantages and objectives without incurring any substantial relative disadvantage.

The above brief description sets forth rather broadly the more important features of the present invention so that the detailed description that follows may be better understood, and so that the present contributions to the art may be better appreciated. Throughout this application, the text refers to various embodiments of the present article of manufacture and/or related methods. The various embodiments described are meant to provide a variety of illustrative examples and should not be construed as descriptions of alternative species. Rather it should be noted that the descriptions of various embodiments provided herein may be of overlapping scope. The embodiments discussed herein are merely illustrative and the invention is not limited in its application to the details of the construction and the arrangements set forth in the following description and/or illustrated in the drawings. The present invention is capable of other embodiments and of being practiced and carried out in various ways, as will be appreciated by those skilled in the art. Also, it is to be understood that the phraseology and terminology employed herein are for description and not limitation, are not meant to limit the scope of the present invention.

DETAILED DESCRIPTION OF THE PREFERRED EMBODIMENT

Figure 1:
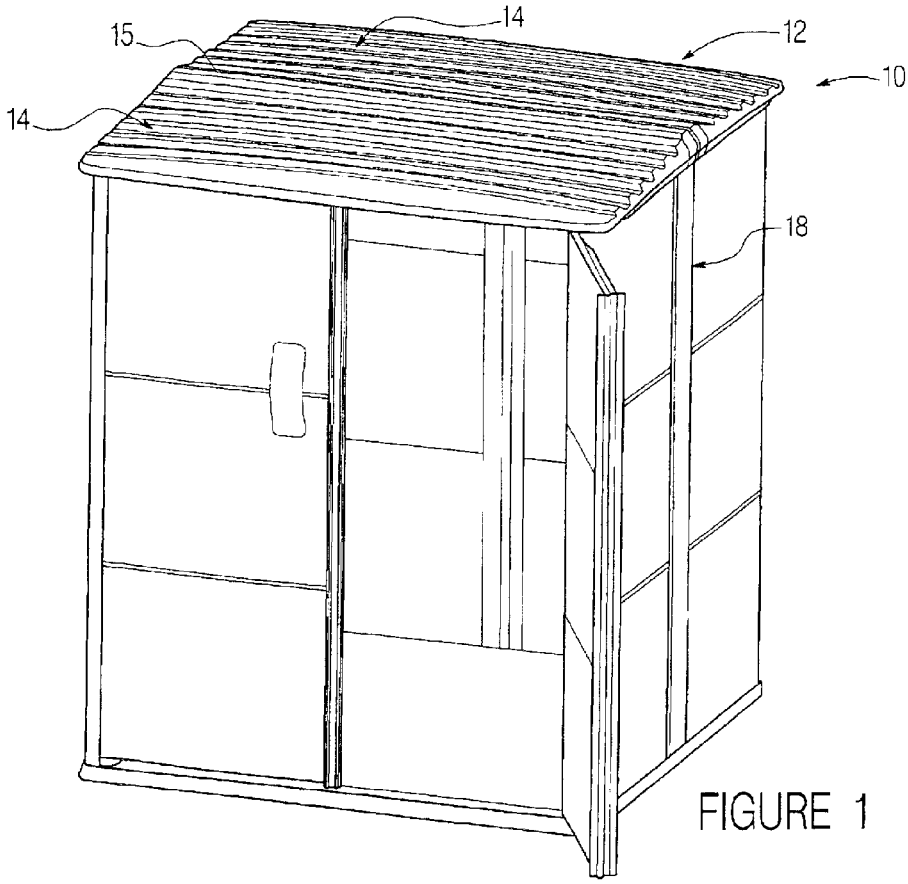
FIG. 1 is a perspective view of a building having shallow pitch roof panels and a roof support according to the preferred embodiment.

Referring to FIG. 1, a small storage or utility building 10 having a shallow-pitched roof 12 is shown according to the preferred embodiment. An example of a building and roof of this type are described in U.S. patent application Ser. No. 09/086,061 titled "Modular Panel Construction System," filed on May 27, 1998, the disclosure of which is incorporated herein by reference. The shallow pitched-roof 12 includes roof panels 14 that are supported along a central peak line 15 of shallow-pitched roof 12 by roof support 20 (not shown in this view).

Figure 2:
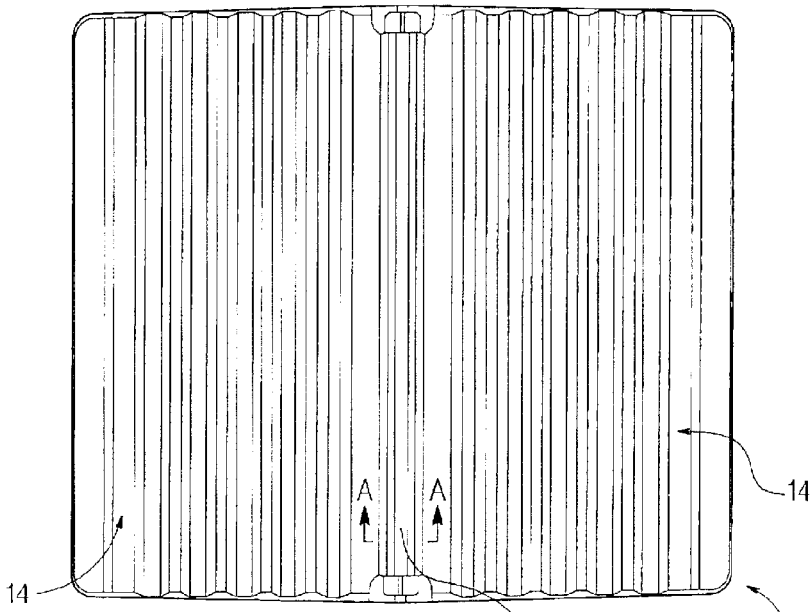
FIG. 2 is a top plan view of the roof according to the preferred embodiment.

FIG. 2 displays the shallow-pitched roof 12 more clearly. The shallow-pitched roof 12 includes two roof panels 14 separated by a centrally positioned roof support 20 that divides the roof 12. The roof support 20 spans the length of building 10 and is supported on either end by the end wall structure 18 of building 10 (shown in FIG. 1). Although a roof having two roof panels is shown and described, it would be apparent to one skilled in the art to construct a roof using a single roof panel.

Figure 3:
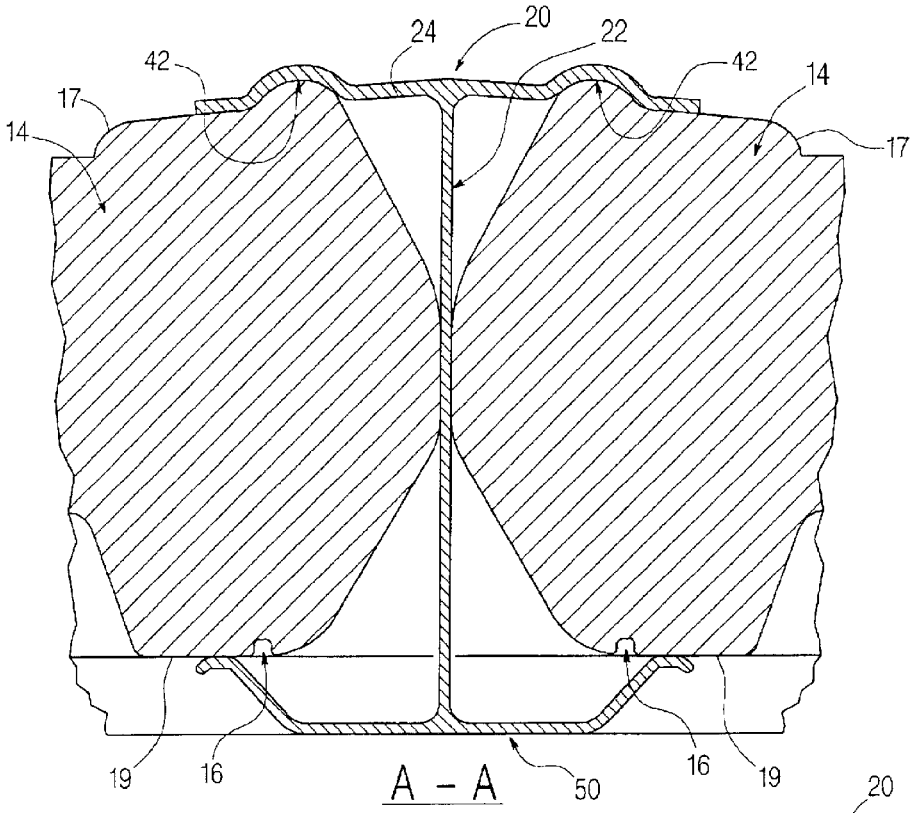
FIG. 3 is a cross sectional view of the roof support along section A—A of FIG. 2 according to the preferred embodiment.

FIG. 3 more clearly displays the roof panel 14 and roof support 20 relationship. Roof panels 14 are positioned in a continuously abutting relationship along both lateral sides of a support web portion 22 of roof support 20. Roof panels 14 have an exterior surface 17 and an interior surface 19. Roof panels 14 are configured with a longitudinal drip edge 16 (e.g. slot, groove, indent, lip, etc.) that extends along the interior surface 19 of the roof panel 14 parallel to the longitudinal axis of the roof support 20. Drip edge 16 provides a discontinuity in the interior panel surface that allows any leaking moisture adhering to roof panel 14 to drip off the panel into the roof support 20 and prevents moisture from migrating laterally beyond the roof support 20.

Roof support 20 includes an exposure surface 24 (e.g., panel joint cover, flaps, shields, protector, etc.) extending along the entire length of roof support 20. Exposure surface 24 projects laterally outward from an upper end of support web 22 and is intended to overlap roof panels 14 on both lateral sides of support web 22 to shield the joint created between the abutting roof panels 14 and support web 22 from rain and other elements of the weather.

Roof support 20 also includes a collector 50 (e.g., tray, channel, pan, trough, etc.) extending along the entire length of roof support 20. Collector 50 projects laterally outward from a lower end of support web 22 and extends beneath a portion of each roof panel 14, slightly beyond the drip edges 16. Collector 50 is configured to capture water that penetrates the joint created between the abutting roof panels 14 and support web 22 and divert the water to a drain (not shown) or away from the interior of the building.

Figure 4:
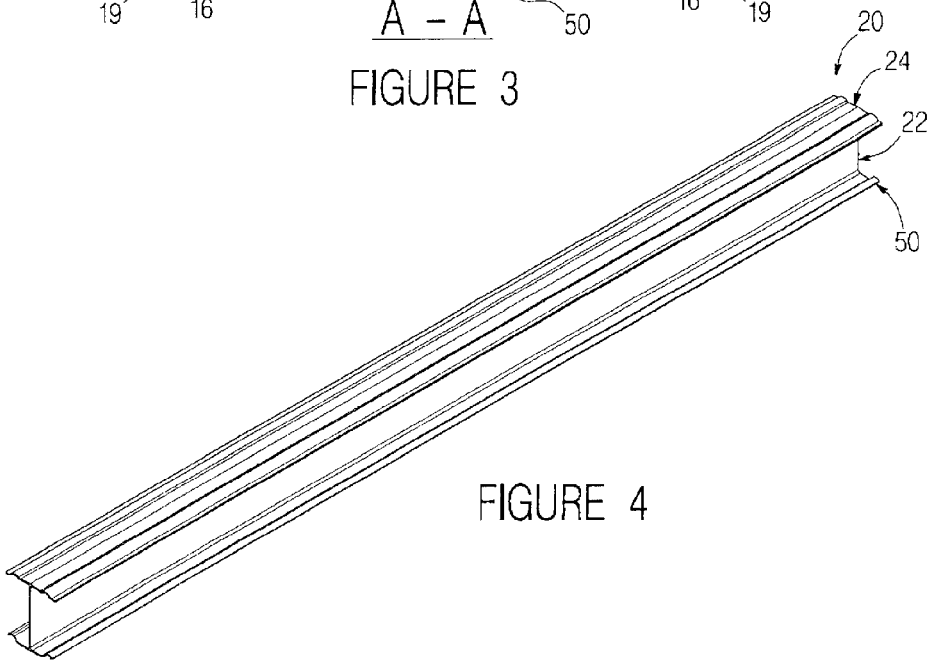
FIG. 4 is a perspective view of the roof support according to the preferred embodiment.
Figure 5:
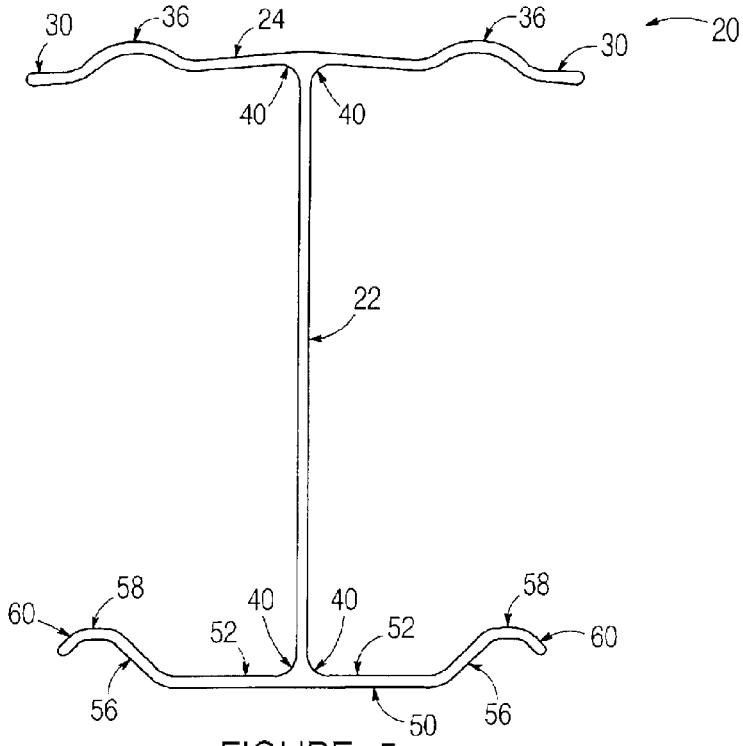
FIG. 5 is a cross sectional view of the roof support according to the preferred embodiment.

Referring to FIGS. 4 and 5, roof support 20 is shown according to a preferred embodiment. Roof support 20 is desirably formed using a thermoset pultrusion process where reinforcing filaments are passed from a fiber delivery system (e.g., reels, spindles, etc.) and pulled through a resin impregnation bath. The resin-embedded fibers are then pulled through preform fixtures (e.g., one or more dies), which contour and align the fiber-resin combination into the roof support shape that will be subsequently described. The contoured fiber-resin combination then passes through a heated fixture or die (not shown) to cure (i.e., "cross-link") the resin. Upon curing, roof support 20 is extracted from the heated die and cut into the lengths that correspond to use in buildings 10 or other structures. Although pultrusion is preferred, other types of methods may be used to form the roof support including extrusion, rollform, weldment, or a combination thereof.

According to a particularly preferred embodiment, roof support 20 has a length of approximately 64 in, and all subsequently described dimensions correspond to a length of approximately 64 in; however the length can be modified to suit a wide variety of building sizes and the subsequently described dimensions may be adjusted accordingly to maintain acceptable deflection levels under a particular set of loading conditions. In a preferred embodiment, the fiber filaments and resin combination have a modulus of elasticity (E) of at least about 2,500,000 pounds per square in (PSI). In the particularly preferred embodiment, the fiber filaments are glass fibers and the resin is a thermoset polyester resin, the combination having a modulus of elasticity (E) of approximately 2,700,000 to 3,300,000 PSI. However, other fibers and resins known in the art may be used, including graphite, polyethylene, vinyl esters, epoxy resins and combinations thereof. The fiber-resin combination may also be cured by other methods known by those skilled in the art, including chemical curing. In further alternative embodiments, roof support 20 may be fabricated with an extrusion process from thermoplastic materials or composites thereof.

Referring further to FIGS. 4 and 5, roof support 20 is formed with a uniform cross-section along its entire length that is symmetrical and generally "I-beam" shaped, and includes a centrally located vertical support web 22. Integrally formed with the support web 22 is the exposure surface 24, which generally perpendicularly bisects the support web 22. Support web 22 is also integral with the collector 50, which also generally perpendicularly bisects the support web 22. In a preferred embodiment, the roof support 20 has a moment of inertia of between about 2.9 $in^4$ and 3.3 $in^4$. In a particularly preferred embodiment, the roof support 20 has a moment of inertia of approximately 3.180 $in^4$, and the support web 22 has a thickness of approximately 0.080 in and a height of approximately 4.222 in. However, the roof support may have a wide range of moment of inertia, and the support web a wide range of thickness and height to meet desired specifications. Further, the support web may be shaped differently when used in combination with a single roof panel to support the roof panel and prevent roof sag.

The exposure surface 24 has flanges 30 (e.g., arms, flaps, etc.) projecting outward in opposing lateral directions from an upper end of support web 22, the underside of flanges 30 having rounded fillets 40 at the juncture with support web 22, although squared fillets would be suitable as well. The outwardly projecting flanges 30 have a shallow negative slope corresponding to the pitch of roof panels 14 to improve the sealing performance of the exposure surface 24 against roof panels 14. The shallow negative slope may be any angle from and including horizontal, which is suitable for providing a tight fit with the pitch of roof panels 14. Flanges 30 may be formed along their length with arcuate projections 36 (e.g., ridges, channels, tracks, etc.) extending parallel to the longitudinal axis of roof support 20 and configured to interface with any corresponding projections 42 on the upper surface of roof panels 14 for improved position retention and sealing performance of roof support 20 (shown most clearly in FIG. 3). In a particularly preferred embodiment, exposure surface 24 has an overall width of approximately 3.750 in and a thickness of approximately 0.080 in, although this may vary depending on desired specifications. Further, exposure surface 24 of roof support 20 and the exterior surface 17 of roof panels 14 have a relative clearance of approximately 0.015 in. Again, the relative clearance between the exposure surface 24 and the exterior surface 17 may vary widely to account for desired specifications.

Referring further to FIGS. 4 and 5, collector 50 is shown according to the preferred embodiment. Collector 50 has flanges 52 (e.g., legs, channels, troughs, etc.) projecting horizontally outward in opposing lateral directions from a lower end of support web 22 with each flange 52 having a distal end. The top side of flanges 52 have rounded fillets 40 at the juncture with support web 22, but the fillets 40 may also be squared. Flanges 52 are formed along the length of their distal ends with an angularly upward projecting lip 56 extending parallel to the longitudinal axis of roof support 20 and configured to interface with a interior surface 19 of roof panels 14. The angular portion of lip 56 has an angle from the top surface of flange 52 of about 90° to 175°, and more preferably about 125° to 145°. The angular portion of lip 56 may include a smooth transition to a horizontal portion 58 and then to a partial return bend end portion 60. Horizontal portion 58 is configured to project slightly beyond drip edge 16 of roof panels 14 to support roof panels 14 and ensure that all moisture that drips from drip edge 16 is captured in collector 50. The depth of collector 50 is determined by the vertical distance between the top surfaces of flanges 52 and horizontal portions 58 of distal ends, and the depth is greater than the maximum expected deflection of roof support 20 under the intended loading conditions to ensure that collected moisture flows to the ends of roof support 20. In a particularly preferred embodiment, collector 50 has an overall width of approximately 3.500 in and a thickness of approximately 0.080 in, and the transition to horizontal portion 58 occurs at a distance of approximately 1.360 in from the centerline of support web 22, with horizontal portion 58 raised above the top side of flanges 52 to provide a collector depth of approximately 0.335 in. In alternative embodiments, the overall width of collector 50 may be increased or decreased any desired amount provided that horizontal portion 58 extends beyond drip edge 16, and the thickness of collector 50 may be any dimension suitable for providing a support and collector function.

Figure 6:
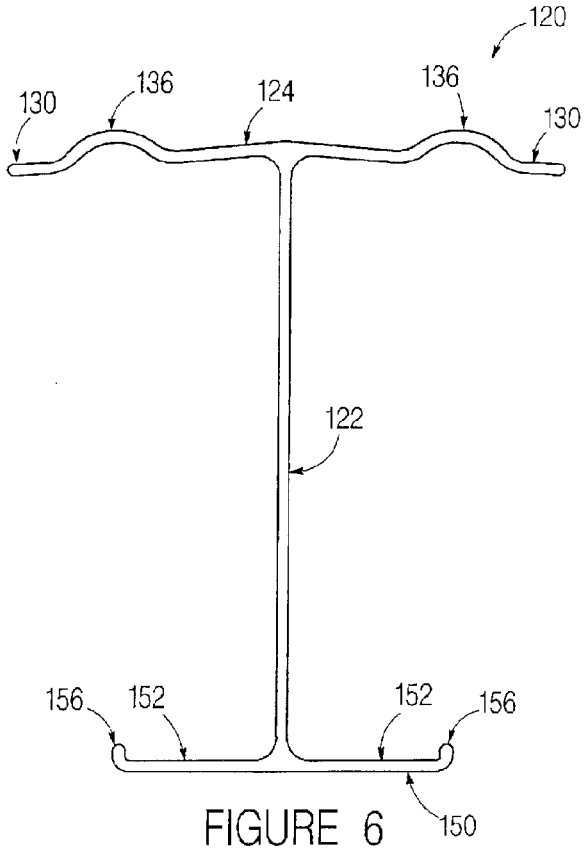
FIG. 6 is a cross sectional view of the roof support according to an alternative embodiment.

Referring to FIG. 6, a roof support 120 is shown according to an alternative embodiment. Roof support 120 is formed with a uniform cross section along its entire length that is symmetrical and generally "I-beam" shaped, having a centrally located vertical support web 122 that generally perpendicularly bisects, and is integrally formed with, the exposure surface 124 and the collector 150. The support web 122 has a thickness of approximately 0.075 in and a height of approximately 3.977 in, which may be either increased or decreased depending on load requirements.

The exposure surface 124 has flanges 130 (e.g., arms, flaps, etc.) projecting outward in opposing lateral directions from an upper end of support web 122. The outwardly projecting flanges 130 have a shallow negative slope corresponding to the pitch of roof panels 14. The shallow negative slope may have any angle from and including to horizontal provide a tight fit with the pitch of roof panels 14. Flanges 130 may be formed along their length with arcuate projections 136 extending parallel to the longitudinal axis of roof support 120 and configured to interface with corresponding projections 42 on the exterior surface 17 of roof panels 14. The exposure surface 124 has an overall width of approximately 3.750 in and a thickness of approximately 0.075 in, which may be either increased or decreased depending on requirements.

The collector 150 also has flanges 152 projecting horizontally outward in opposing lateral directions from a lower end of support web 122. Flanges 152 are formed along their distal ends with an upward projecting lip 156 that extends parallel to the longitudinal axis of roof support 120.

It is also important to note that the construction and arrangement of the elements of the roof support as shown in the preferred and other exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, the roof support may be fabricated by aluminum extrusion, plastic extrusion or molding, metal roll forming, formed and welded metal assembly, etc. or a composite thereof and the dimensions may be tailored according to the width spanned by the roof support and the intended loading requirements. Accordingly, all such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the preferred and other exemplary embodiments without departing from the spirit of the present inventions as expressed in the appended claims.

What is claimed is:

1. A roof panel and roof structure combination comprising:

at least one roof panel including an exterior surface and an interior surface, wherein the exterior surface of the roof panel includes an arcuate projection; and a roof structure including an exposure surface having flanges projecting outward in opposing lateral directions, wherein at least one flange of the exposure surface of the roof structure includes an arcuate channel, the arcuate channel being configures to interface with the arcuate projection of the roof panel, a collector including opposing lateral distal edges that upwardly extend from the collector, and a support web integral with and perpendicularly bisecting the exposure surface and the collector, wherein the exposure surface is opposite the collector, and wherein the roof panel is closely adjacent to the support web, and the distal edges of the collector supports the roof panel.

2. The combination of claim 1, wherein the distal edges upwardly extend from the collector at an angle of about 90 to 175 degrees.

3. The combination of claim 1, wherein the distal edges upwardly extend from the collector at an angle of about 125 to 145 degrees.

4. The combination of claim 1, wherein the collector has a depth greater than a maximum expected deflection of the roof structure.

5. The combination of claim 1, wherein the distal edges are generally parallel to the support web.

6. The combination of claim 1, wherein the roof structure is manufactured by a pultrusion process, extrusion process, weldment process, rollform process, or a combination thereof.

7. The combination of claim 1, wherein the roof panel includes a drip edge extending longitudinally along the interior surface of the roof panel.

8. The combination of claim 7, wherein the drip edge extends parallel with the longitudinal axis of the roof panel.

9. The combination of claim 1, wherein the arcuate channel extends parallel to the longitudinal axis of the roof support.

10. A roof panel and roof structure combination comprising:

at least one roof panel including an exterior surface and an interior surface; and a roof structure having a modulus of elasticity of at least about 2,500,000 pounds per square inch including an exposure surface, a collector including opposing lateral distal edges that upwardly extend from the collector, a support web integral with and perpendicularly bisecting the exposure surface and the collector, wherein the exposure surface is opposite the collector, and wherein the roof panel is closely adjacent to the support web, and the distal edges of the collector supports the roof panel.

11. The combination of claim 10, wherein the distal edges upwardly extend from the collector at an angle of about 90 to 175 degrees.

12. The combination of claim 10, wherein the distal edges upwardly extend from the collector at an angle of about 125 to 145 degrees.

13. The combination of claim 10, wherein the collector has a depth greater than a maximum expected deflection of the roof structure.

14. The combination of claim 10, wherein the distal edges are generally parallel to the support web.

15. The combination of claim 10, wherein the roof structure is manufactured by a pultrusion process, extrusion process, weldment process, rollform process, or a combination thereof.

16. The combination of claim 10, wherein the roof panel includes a drip edge.

17. The combination of claim 16, wherein the drip edge extends longitudinally along the interior surface of the roof panel.

18. The combination of claim 16, wherein the drip edge extends parallel with the longitudinal axis of the roof panel.

19. The combination of claim 10, wherein the exposure surface includes flanges projecting outward in opposing lateral directions.

20. The combination of claim 16, wherein at least one flange includes an arcuate channel, the arcuate channel being configured to interface with an arcuate projection on the roof panel.

21. The combination of claim 20, wherein the arcuate channel extends parallel to the longitudinal axis of the roof structure.

* * * * *